US011382426B2

(12) United States Patent
Sun

(10) Patent No.: US 11,382,426 B2
(45) Date of Patent: Jul. 12, 2022

(54) BLEACHER SEAT WITH RETRACTABLE AND FOLDABLE ARMRESTS

(71) Applicant: Benlong Sun, Jinhua (CN)

(72) Inventor: Benlong Sun, Jinhua (CN)

(73) Assignee: ZHEJIANG PRIDE LEISURE PRODUCTS CO., LTD., Zhejiang Province (CN)

( * ) Notice: Subject to any disclaimer, the term of this patent is extended or adjusted under 35 U.S.C. 154(b) by 0 days.

(21) Appl. No.: 17/019,382

(22) Filed: Sep. 14, 2020

(65) Prior Publication Data

US 2020/0405055 A1 Dec. 31, 2020

(51) Int. Cl.
*A47C 1/16* (2006.01)
*A47C 7/40* (2006.01)
(Continued)

(52) U.S. Cl.
CPC ..... *A47C 1/16* (2013.01); *A47C 4/30* (2013.01); *A47C 5/10* (2013.01); *A47C 7/543* (2013.01)

(58) Field of Classification Search
CPC .... A47C 1/16; A47C 5/10; A47C 4/30; A47C 7/543; A47C 7/407
(Continued)

(56) References Cited

U.S. PATENT DOCUMENTS 116,934 A * 7/1871 Cutter ..... A47C 1/16 297/252
1,293,592 A * 2/1919 Wilber et al. ..... A47C 1/16 297/252
(Continued)

FOREIGN PATENT DOCUMENTS

DE 202013104794 U1 * 1/2014 ..... A47C 1/16
FR 353957 A * 9/1905 ..... A47C 4/52
FR 472312 A * 12/1914 ..... A47C 7/543

*Primary Examiner* — Robert Canfield
(74) *Attorney, Agent, or Firm* — WPAT Law, P.C.; Anthony King

(57) ABSTRACT

A bleacher seat with retractable and foldable armrests comprises two hook assemblies, a cushion assembly, a backrest assembly, two cushion-backrest connecting assemblies and two armrest assemblies, wherein the two hook assemblies are symmetrically arranged at the front end of the bottom surface of the cushion assembly, the lower ends of the two symmetrical cushion-backrest connecting assemblies are fixedly mounted at the rear ends of left and right sides of the cushion assembly respectively, and the upper ends of the two cushion-backrest connecting assemblies are symmetrically arranged at and rotatably connected to the lower ends of two sides of the backrest assembly. The two armrest assemblies are arranged symmetrically, the upper end and lower end of each armrest assembly are rotatably connected to a corresponding side of the cushion assembly and a corresponding side of the backrest assembly respectively, and the armrest assemblies are retractable; and a detachable cushion cloth is arranged on the cushion assembly, and a detachable backrest cloth is arranged on the backrest assembly. Armrests of the bleacher seat are retractable and foldable, all components are rotatably connected, and the cushion cloth and backrest cloth are detachable, so that the bleacher can be folded to be stored.

19 Claims, 20 Drawing Sheets

(51) Int. Cl.
*A47C 4/30* (2006.01)
*A47C 7/54* (2006.01)
*A47C 5/10* (2006.01)

(58) Field of Classification Search
USPC ..... 297/35, 256.16
See application file for complete search history.

(56) References Cited

U.S. PATENT DOCUMENTS 1,293,778 A * 2/1919 Holm ..... A47C 1/16 297/252
2,108,531 A * 2/1938 Flanders ..... A47C 1/146 297/380
2,189,520 A * 2/1940 Inzerillo ..... A47L 3/02 182/58
2,306,673 A * 12/1942 Tucker ..... A47C 1/16 297/252
2,466,361 A * 4/1949 Bjornskaas ..... A47C 1/16 297/252
2,571,282 A * 10/1951 Newton ..... A47C 1/16 297/252
2,702,076 A * 2/1955 Beardsley ..... A47C 1/16 297/252
2,725,925 A * 12/1955 Sanderson ..... A47C 1/16 297/252
2,957,515 A * 10/1960 Gibson ..... A47C 4/18 297/252
3,026,142 A * 3/1962 Holloway ..... A47C 1/16 297/252
3,994,529 A * 11/1976 Lippert ..... A47C 1/16 297/252
5,934,751 A * 8/1999 Johnson ..... A47C 1/16 297/252
6,203,108 B1 * 3/2001 Mattison, Jr. ..... A47C 1/16 297/252
8,075,059 B2 * 12/2011 Kim ..... A47C 4/42 297/378.12
D802,317 S * 11/2017 Head, Jr ..... D6/368
D814,820 S * 4/2018 Meoli, Jr. ..... D6/368
10,694,851 B2 * 6/2020 Zhu ..... A47C 1/16
2009/0212614 A1 * 8/2009 Isaac ..... A47C 4/283 297/252
2019/0231074 A1 * 8/2019 Grace ..... A47C 4/28
2020/0054139 A1 * 2/2020 Morley, Jr. ..... A47C 4/22

* cited by examiner

BLEACHER SEAT WITH RETRACTABLE AND FOLDABLE ARMRESTS

BACKGROUND OF THE INVENTION

1. Technical Field

This utility model belongs to the technical field of bleacher seats, and particularly relates to a bleacher seat with retractable and foldable armrests.

2. Description of Related Art

Nowadays, the vigorous development of social productivity has greatly improved the creature comfort and spiritual pursuit of people and brought more and more large-scale sports matches, concerts, and evening parties, which in turn promote the emergence of derivatives such as movable bleachers and bleacher seats, wherein movable bleacher seats not only need to be designed to be steady and firm, but also should be attractive, durable, and easy to assemble. In general, traditional bleacher seats are integrally formed by plastic through one-time die casting, or are formed by the combination of a non-detachable hard frame and a soft cloth cover, wherein the former ones are easy to clean, but are poor in long-term sitting comfort, and the later ones have better sitting comfort than the former ones, but are difficult to clean after being stained.

In view of this, the structure of traditional bleacher seats needs to be improved.

BRIEF SUMMARY OF THE INVENTION

The objective of this utility model is to overcome the defects of poor long-term sitting comfort and inconvenient cleaning of traditional bleacher seats by providing a bleacher seat with retractable and foldable armrests. The bleacher seat is foldable on the whole, has a cloth cover capable of being disassembled to be cleaned, and adopts retractable armrests and an embedded backrest cloth structure, and the armrests, hooks, and backrest assembly can be folded to facilitate transportation and storage.

The following technical solution is adopted by this utility model to fulfill the aforesaid objective: a bleacher seat with retractable and foldable armrests comprises two hook assemblies, a cushion assembly, a backrest assembly, two cushion-backrest connecting assemblies and two armrest assemblies, wherein the two hook assemblies are symmetrically arranged at the front end of the bottom surface of the cushion assembly, the lower ends of the two symmetrical cushion-backrest connecting assemblies are fixedly mounted at the rear ends of the left and right sides of the cushion assembly respectively, and the upper ends of the two cushion-backrest connecting assemblies are symmetrically arranged at and rotatably connected to the lower ends of two sides of the backrest assembly. The two armrest assemblies are arranged symmetrically, the upper end and lower end of each armrest assembly are rotatably connected to a corresponding side of the cushion assembly and a corresponding side of the backrest assembly respectively, and the armrest assemblies are retractable, and a detachable cushion cloth is arranged on the cushion assembly, and a detachable backrest cloth is arranged on the backrest assembly. Armrests of the bleacher seat are retractable and foldable, all components are rotatably connected, and the cushion cloth and backrest cloth are detachable, so that the bleacher can be folded to be stored.

Furthermore, each armrest assembly of one structure of this utility model comprises a slotted armrest and a telescopic tube, wherein a long slot is formed in a joint of the slotted armrest and the left side or right side of the backrest assembly, a rivet sequentially penetrates through the long slot, a gasket and the side face of a backrest weld assembly, and the front end of the lower surface of the slotted armrest is rotatably connected to the upper end of the telescopic tube, and the lower end of the telescopic tube is rotatably connected to the left side or right side of the cushion assembly.

Furthermore, the telescopic tube comprises a lower vertical armrest tube, an upper vertical armrest tube and a spring fastener, wherein the lower vertical armrest tube and the upper vertical armrest tube are hollow tubes, and the upper vertical armrest tube is disposed around the upper end of the lower vertical armrest tube; a spring fastener fixing hole is formed in the upper end of the lower vertical armrest tube, the U-shaped spring fastener is mounted inside the lower vertical armrest tube, and a spring fastener protrusion is arranged on any side of the upper end of the spring fastener and stretches out of the spring fastener fixing hole. The upper vertical armrest tube has an upper vertical tube hole I and an upper vertical tube hole II which are formed along the same straight line in a length direction and are located at different heights, and is able to slide upwards and downwards, and the spring fastener fixing hole penetrates through the upper vertical tube hole I or the upper vertical tube hole II; and the lower end of the lower vertical armrest tube is rotatably connected to the left side or right side of the cushion assembly.

Furthermore, each armrest assembly of a second structure of this utility model comprises a pull-type armrest, a square armrest tube and an upright armrest tube, wherein a long slot is formed in the bottom surface of the pull-type armrest, the square armrest tube slides in the long slot, the lower surface of the front end of the square armrest tube is rotatably connected to the upper end of the upright armrest tube, the rear end of the square armrest tube is rotatably connected to the left side or right side of the backrest assembly; and the lower end of the upright armrest tube is rotatably connected to the left side or right side of the cushion assembly.

Furthermore, each armrest assembly of a third structure of this utility model comprises a rear folding armrest piece, a front folding armrest piece, an armrest support tube and a support tube fixing piece, wherein a through hole is formed in the rear end of the rear folding armrest piece, and a rivet penetrates through the through hole to rotatably connect the rear end of the rear folding armrest piece to the left side or right side of the backrest assembly; and a biconcave notch is formed in the front end of the rear folding armrest assembly and allows a biconvex protrusion at the rear end of the front folding armrest piece to be assembled therein through a rivet to rotatably connect the front end of the rear folding armrest assembly to the rear end of the front folding armrest piece. The front end of the front folding armrest piece is rotatably connected to the upper end of the armrest support tube, two through holes are formed in the lower end of the armrest support tube and are located at different heights, a screw penetrates through one through hole to be fixed to the support tube fixing piece, and the armrest support tube is able to rotate around the screw; and an arc groove is formed in the support tube fixing piece, and a short bolt penetrates through the other through hole and the arc groove to be fixed and is able to slide along the arc groove to rotatably connect the lower end of the armrest support tube to the left side or right side of the cushion assembly; and the support tube fixing piece is fixed to the left side or right side of the cushion assembly through a rivet.

Furthermore, the cushion assembly comprises an n-shaped cushion tube weld assembly, the cushion cloth, two square tube sleeves and a rear tube, wherein the front side, left side, and right side of the cushion cloth are detachably connected to three edges of the n-shaped cushion tube weld assembly respectively, and the rear end of the cushion cloth is wound around an outer circle of the rear tube through a rear cushion cloth tube sleeve. The front ends of the square tube sleeves are mounted at the rear ends of the left and right sides of the cushion tube weld assembly; mounting holes for mounting the rear tube are formed in the sides, facing each other, of the two square tube sleeves, and the two square tube sleeves are respectively mounted at the two ends of the rear tube via the mounting holes; and through holes are formed in the square tube sleeves, and self-tapping screws sequentially penetrate through the through holes of the square tube sleeves and the end face of the rear tube to be fixed; and the two hook assemblies are respectively mounted on the inner surfaces of front portions of the left and right sides of the cushion tube weld assembly.

Furthermore, the cushion assembly further comprises a front cushion cloth pressing piece and two side cushion cloth pressing pieces, wherein the cushion tube weld assembly comprises a horizontal square tube, two side square tubes, two hook holders and two side cloth-pulling tubes. The two side square tubes are symmetrically welded to the two ends of the horizontal square tube to form an n shape, and the two arched side cloth-pulling tubes are respectively welded to the upper ends of the two side square tubes; and the two hook holders are respectively welded to the sides, close to the horizontal square tube, of the two side square tubes, and the hook assemblies are mounted on the hook holders; side cushion cloth rims on the left and right sides of the cushion cloth are wound around the two side cloth-pulling tubes, are pressed against the side cloth-pulling tubes by means of the side cushion cloth pressing pieces, and are fixed with pressing piece screws; and a front cushion cloth rim on the front side of the cushion cloth is wound around the horizontal square tube, is pressed against the horizontal square tube by means of the front cushion cloth pressing piece, and is fixed with a pressing piece screw.

Furthermore, the backrest assembly comprises two cloth embedding strips, the backrest cloth, the backrest weld assembly and four slotted tube plugs, wherein the backrest weld assembly is an n-shaped structure formed by welding two vertical backrest rods and a horizontal backrest tube, circular slots are formed in sides, towards a human body, of the two vertical backrest rods, cylindrical sleeves allowing the cloth embedding strips to be inserted therein are arranged on the left and right sides of the backrest cloth, and the cylindrical sleeves having the cloth embedding strips inserted therein are embedded in the circular slots; and the four slotted tube plugs seal open ends of the two vertical backrest rods.

Furthermore, each cushion-backrest connecting assembly comprises an outer cushion-backrest connecting piece and a cushion-backrest big-hole connecting piece, wherein the outer cushion-backrest connecting piece is riveted to the outer sides of the rear ends of the side square tubes of the cushion tube weld assembly, and the lower ends of the vertical backrest rods of the cushion-backrest weld assembly are rotatably connected to the outer cushion-backrest connecting piece and the cushion-backrest big-hole connecting piece.

Furthermore, each hook assembly comprises a fixing screw, a plastic sheath, a metal hook and a self-locking nut, wherein the plastic sheath wraps around the metal hook, and the fixing screw sequentially penetrates through a through hole in the corresponding hook holder 38 of the cushion assembly, a through hole in the plastic sheath and a through hole in the metal hook to be locked with the self-locking nut.

Compared with the prior art, this utility model has the following beneficial effects: the bleacher seat is simple in structure, attractive, elegant, firm and durable. The whole bleacher seat is foldable, thus occupying a small space when carried and transported, and being more suitable for mass transportation, application, and more convenient to use. The structures of slotted tube sliding armrests are conducive to autonomous adjustment by users and conform to an ergonomic sitting posture, and the cushion cloth and the backrest cloth can be easily disassembled to be cleaned and can be used repeatedly.

In the figures: 1, hook assembly; 2, cushion assembly; 3, cushion cloth; 4, armrest assembly; 5, backrest cloth; 6, backrest assembly; 7, cushion-backrest connecting assembly; 8, lower vertical armrest tube; 9, upper vertical armrest tube; 10, slotted armrest; 11, backrest weld assembly; 12, spring fastener protrusion; 13, horizontal backrest tube; 14, front cushion cloth pressing piece; 15, pressing piece screw; 16, fastening screw; 17, side cushion cloth pressing piece; 18, cloth embedding strip; 19, slotted tube plug; 20, circuit slot; 21, side cushion cloth rim; 22, front cushion cloth rim; 23, rear cushion cloth tube sleeve; 24, rivet; 25, self-tapping screw; 26, outer cushion-backrest connecting piece; 27, square tube sleeve; 28, cushion-backrest big-hole connecting piece; 29, semicircular notch; 30, rear tube; 31, side cloth-pulling tube; 32, rubber pad; 33, horizontal square tube; 34, fixing screw; 35, plastic sheath; 36, metal hook; 37, self-locking nut; 38, hook holder; 39, gasket; 40, long slot; 41, U-shaped fork; 42, spring fastener; 43, small gasket; 44, big gasket; 45, upper vertical tube hole II; 46, upper vertical tube hole I; 47, lower vertical tube spring fastener fixing hole; 48, pull-type armrest assembly; 49, long slot; 50, pull-type armrest; 51, square armrest tube; 52, tube plug; 53, nut; 54, shim plate; 55, U-shaped armrest piece; 56, screw; 57, upright armrest tube; 58, internal hexagonal screw; 59, upright armrest tube gasket; 60, folding armrest assembly; 61, square tube-rope cushion cloth; 62, rope; 63, rear folding armrest piece; 64, biconcave notch; 65, biconvex protrusion; 66, front folding armrest piece; 67, big notch; 68, circular armrest connecting head; 69, armrest support tube; 70, support tube fixing piece; 71, arc groove; 72, short bolt; 73, semicircular ring matching base; 74, metal ring through hole; 75, rim.

DETAILED DESCRIPTION OF THE INVENTION

The technical solution of the invention is further described and explained below with reference to specific embodiments to be understood more clearly. Those skilled in the art can easily appreciate other advantages and effects of the invention by referring to the contents in the specification. This utility model can also be implemented or applied in other different forms, and various modifications or transformations can be made to the details in the specification on the basis of different viewpoints and different applications without departing from the spirit of this utility model.

Embodiment 1

Figure 1:
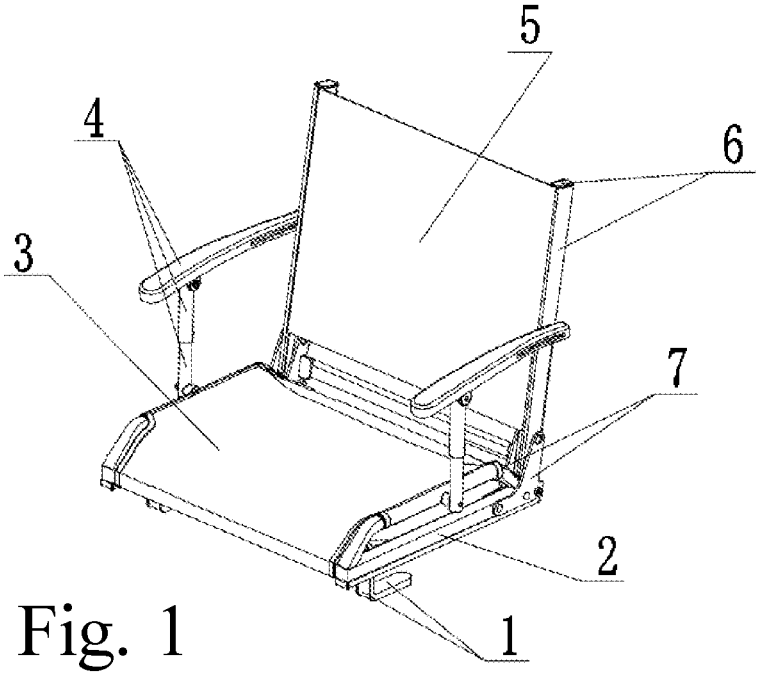
FIG. 1 is an unfolded axonometric diagram of a bleacher seat with slotted pipe sliding armrests.

This embodiment provides a bleacher seat with retractable and foldable armrests, which primarily consists of two hook assemblies 1, a cushion assembly 2, a backrest assembly 6, two cushion-backrest connecting assemblies 7, and two armrest assemblies 4 (as shown in FIG. 1). The bleacher seat has an unfolded state and a folded state (as shown in FIG. 2*a* and FIG. 2*b*, and FIG. 3*a* and FIG. 3*b*), wherein in FIG. 2*a*, sliding armrests and a backrest of the bleacher seat are unfolded to be in a service condition; in FIG. 2*b*, the sliding armrests of the bleacher seat are retracted and folded; in FIG. 3*a*, the backrest assembly 6 of the bleacher seat faces upwards; and in FIG. 3*b*, the cushion assembly 2 and the hook assemblies 1 face upwards.

Particularly, the two hook assemblies 1 are symmetrically arranged at the front end of the bottom surface of the cushion assembly 2, the lower ends of the two symmetrical cushion-backrest connecting assemblies 7 are fixedly mounted at the rear ends of the left and right sides of the cushion assembly 2 respectively, and the upper ends of the two cushion-backrest connecting assemblies 7 are symmetrically arranged at and rotatably connected to the lower ends of two sides of the backrest assembly 6. The two armrest assemblies 4 are arranged symmetrically, the upper end and lower end of each armrest assembly 4 are rotatably connected to a corresponding side of the cushion assembly 2 and a corresponding side of the backrest assembly 6 respectively, and the armrest assemblies 4 are retractable; and a detachable cushion cloth 3 is arranged on the cushion assembly 2, and a detachable backrest cloth 5 is arranged on the backrest assembly 6.

Figure 6:
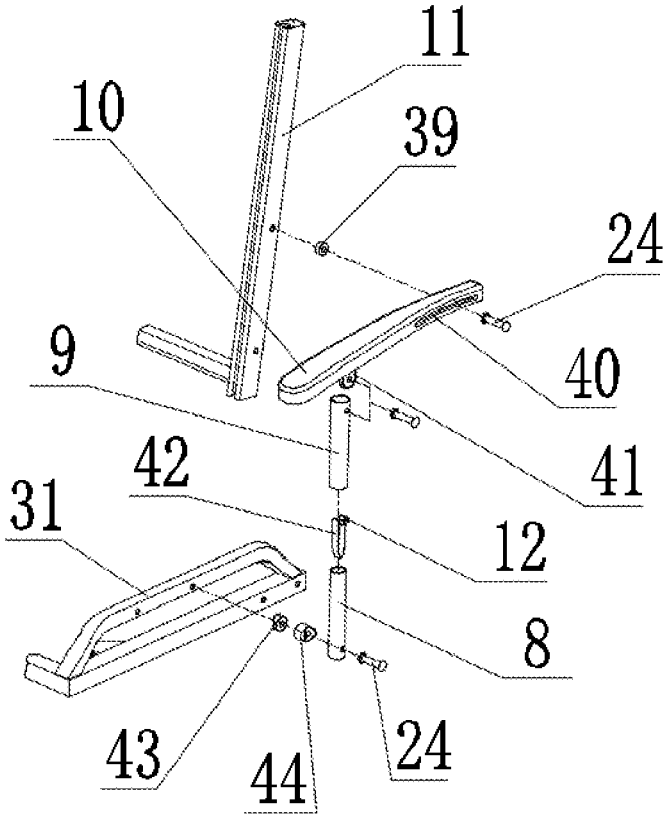
FIG. 6 is an exploded view of a sliding armrest assembly of the bleacher seat with slotted pipe sliding armrests.
Figure 7A:
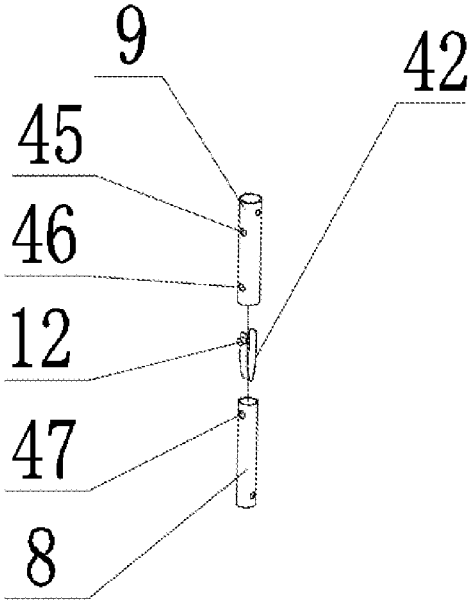
FIG. 7*a* is a schematic diagram of a vertical tube, in an unfolded state, of a sliding armrest.
Figure 7B:
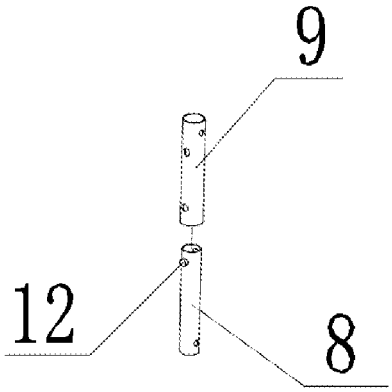
FIG. 7*b* is a schematic diagram of the vertical tube, in a folded state, of the sliding armrest.
Figure 7C:
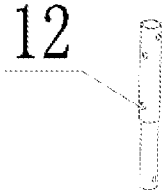
FIG. 7*c* is a schematic diagram of the armrest vertical tube in a locked state when the bleacher seat is unfolded.
Figure 7D:
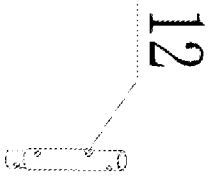
FIG. 7*d* is a schematic diagram of the armrest vertical tube in a locked state when the bleacher seat is folded.

In this embodiment, each armrest assembly 4 (shown in FIG. 6) primarily comprises a slotted armrest 10, a telescopic tube consisting of an upper vertical armrest tube 9, a lower vertical armrest tube 8 and a spring fastener 42, three rivets 24, a gasket 39, a small gasket 43, and a big gasket 44, wherein a long slot 40 is formed in a joint of the slotted armrest 10 and a backrest weld assembly 11 on the left side or right side of the backrest assembly 6, and one rivet 24 sequentially penetrates through the long slot 40, the gasket 39, and the side face of the backrest weld assembly 11; and the front end of the lower surface of the slotted armrest 10 is rotatably connected to the upper end of the telescopic tube, the lower end of the telescopic tube is rotatably connected to the left side or right side of the cushion assembly 2, particularly, a U-shaped fork 41 (U-shaped joint) is arranged on the side, towards the ground, of the slotted armrest 10, and the upper vertical armrest tube 9 penetrates through a concave part of the U-shaped fork 41 and is rotatably connected to the U-shaped fork 41 through another rivet 24.

The lower vertical armrest tube 8 and the upper vertical armrest tube 9 of the telescopic tube of the armrest assembly 4 are hollow tubular structures, and the upper vertical armrest tube 9 is disposed around the upper end of the lower vertical armrest tube 8; a spring fastener fixing hole 47 is formed in the upper end of the lower vertical armrest tube 8, the U-shaped spring fastener 42 is mounted inside the lower vertical armrest tube 8 and is made of a leaf spring, and under the elastic effect, a spring fastener protrusion 12 which is arranged on any side of the upper end of the spring fastener 42 stretches out of the spring fastener fixing hole 47 to be exposed to the outer circumferential face of the lower vertical armrest tube 8; an upper vertical tube hole I 46 and an upper vertical tube hole II 45 are formed in the upper vertical armrest tube 9 along the same straight line in a length direction and are spaced from each other by a certain distance, the upper vertical armrest tube 9 is able to slide upwards or downwards, and the spring fastener fixing hole 47 penetrates through the upper vertical tube hole I 46 or the upper vertical tube hole II 45; and the lower end of the lower vertical armrest tube 8 is rotatably connected to the left side or right side of the cushion assembly 2. A through hole is formed in the lower end of the lower vertical armrest tube 8, the rivet 24 penetrates through the through hole to be rotatably connected to the outer side of the cushion assembly 2 (to be specific, a side cloth-pulling tube 31), and the small gasket 43 and the big gasket 44 are mounted between the lower vertical armrest tube 8 and the side cloth-pulling tube 31 of the cushion assembly 2 to fulfill a buffer effect, and the rivet 24 sequentially penetrates through the lower end of the lower vertical armrest tube 8, the big gasket 44, and the small gasket 43 to be connected to the left side or right side of the cushion assembly 2. The surfaces of the big cushion 44 and the small cushion 43 can be designed in shapes matched with contact surfaces, for example, the surface, in contact with the lower vertical armrest tube 8, of the big gasket 44 can be designed as an arc surface matched with the outer surface of the lower vertical armrest tube 8.

In this embodiment, the cushion assembly 2 (shown in FIG. 5) primarily consists of a cushion tube weld assembly, the cushion cloth 3, two square tube sleeves 27, a front cushion cloth pressing piece 14, two side cushion cloth pressing pieces 17, nine pressing piece screws 15, a rear tube 30, two self-tapping screws 25, six fastening screws 16, and two rubber pads 32, wherein the cushion tube weld assembly is n-shaped, the front side, the left side, and the right side of the cushion cloth 3 are detachably connected to three edges of the n-shaped cushion tube weld assembly respectively, and the rear end of the cushion cloth 3 is wound around the outer circle of the rear tube 30 by means of a rear cushion cloth tube sleeve 23. The two square tube sleeves 27 are respectively disposed around the rear open ends of left and right side square tubes of the cushion tube weld assembly; mounting holes for mounting the rear tube 30 are formed in sides facing each other (inner sides) of the two square tube sleeves 27, and the two square tube sleeves 27 are respectively mounted at the two ends of the rear tube 30 via the mounting holes; through holes are formed in sides backing onto each other (outer sides) of the two square tube sleeves 27, the self-tapping screws 25 sequentially penetrate through the through holes of the square tube sleeves 27 and one end face of the rear tube 30 to fulfill fixation, and threads are tapped on the two end faces of the rear tube 30 for connection and fastening; and the two hook assemblies 2 are respectively mounted on the inner surfaces of front portions of the left and right sides of the cushion tube weld assembly. The self-tapping screws 25 are preferably internal hexagonal self-taping screws. Particularly, the cushion tube weld assembly comprises a horizontal square tube 33, two side square tubes, two hook holders 38, and two side cloth-pulling tubes 31, wherein the two side square tubes are symmetrically welded to the two ends of the horizontal square tube 33 to form an n shape, the two arched side cloth-pulling tubes 31 are respectively welded to the upper ends of the two side square tubes, the two hook holders 38 are respectively welded to the sides, close to the horizontal square tube 33, of the two side square tubes, and the hook assemblies 1 are detachably mounted on the hook holders 38; side cushion cloth rims 21 on the left and right sides of the cushion cloth 3 are respectively wound around the two side cloth-pulling tubes 31, are pressed against the side cloth-pulling tubes 31 by means of the side cushion cloth pressing pieces 17, and are fixed with the corresponding pressing piece screws 15; and the front side of the cushion cloth 3 is wound around the horizontal square tube 33 by means of a front cushion cloth rim 22, is pressed against the horizontal square tube 33 by means of the front cushion cloth pressing piece 22, and is fixed with the corresponding pressing piece screws 15. The two rubber pads 32 are respectively arranged on the left side and the right side and are fixedly mounted on the sides, towards the ground, of the left and right side square tubes of the cushion tube weld assembly through the fastening screws 16.

In this embodiment, the backrest assembly 6 (shown in FIG. 4) primarily consists of two cloth embedding strips 18, the backrest cloth 5, a backrest weld assembly 11, and four slotted tube plugs 19, wherein the backrest weld assembly 11 is an n-shaped structure formed by welding two vertical backrest rods and a horizontal backrest tube 13, the two vertical backrest tubes are profiles, circular slots 20 are formed in the sides, towards the back of a human body, of the two vertical backrest rods, the left and right sides, connected to the vertical backrest rods, of the backrest cloth 5 are designed as cylindrical sleeves, outer circles of the cylindrical sleeves on the two sides of the backrest cloth 5 are slightly smaller than inner circles of the circular slots 20 in the vertical backrest rods, the cloth embedding strips 18 are inserted into the cylindrical sleeves and are then embedded into the circular slots 20 to be mounted and fixed, and a large flat surface of the backrest cloth 5 is located between the two vertical backrest rods of the backrest assembly 6 and is elastically tensioned slightly; and the four slotted tube plugs 19 are used to seal and close the open ends of the two vertical profiles of the backrest assembly 6.

In this embodiment, the two cushion-backrest connecting assemblies 7 (shown in FIG. 5) are used to fixedly connect the backrest assembly 6 to the cushion assembly 2. Each cushion-backrest connecting assembly 7 primarily consists of an outer cushion-backrest connecting piece 26, a cushion-backrest big-hole connecting piece 28, and three rivets 24 used for connection and fixation, wherein the outer cushion-backrest connecting piece 26 is fixedly mounted on the outer sides of the rear ends of the side square tubes of the cushion tube weld assembly, the cushion-backrest big-hole connecting piece 28 is fixed to the inner sides of the left and right side square tubes of the cushion tube weld assembly, and the lower ends of the vertical backrest rods of the backrest weld assembly 11 are rotatably connected to the outer cushion-backrest connecting piece 26 and the cushion-backrest big-hole connecting piece 28. A semicircular notch 29 is designed in the cushion-backrest big-hole connecting piece 28 to avoid interference with the outer circle of the rear tube 30.

Figure 3A:
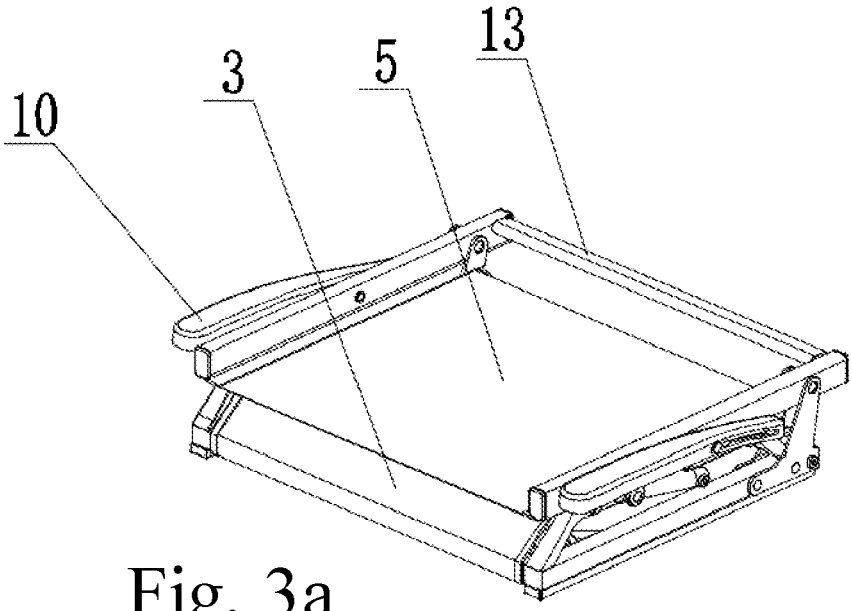
FIG. 3*a* is a schematic diagram of the bleacher seat with slotted pipe sliding armrests in the state where a folded backrest faces upwards.
Figure 5:
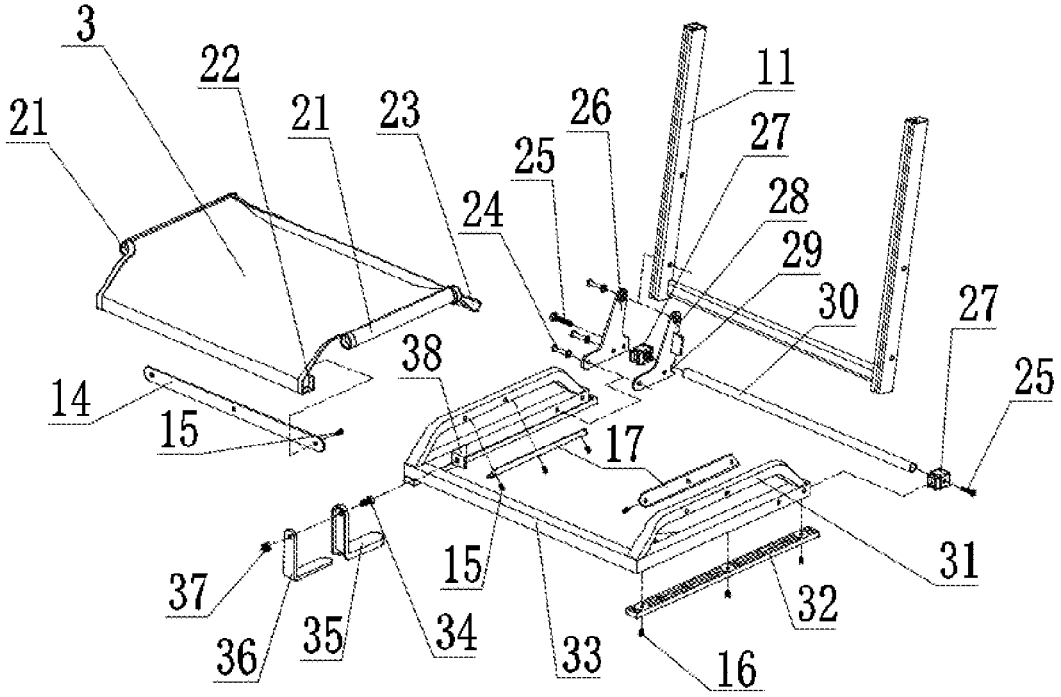
FIG. 5 is a partially exploded view of a cushion assembly of the bleacher seat with slotted pipe sliding armrests.

In this embodiment, the two hook assemblies 2 are respectively mounted on the hook holders 38, close to the horizontal square tube 33, at the front ends of the two side square tubes of the cushion assembly 2 and are located below the cushion cloth 3. Each hook assembly 1 consists of a fixing screw 34, a plastic sheath 35, a meal hook 36 and a self-locking nut 37, wherein as shown in FIG. 5, the plastic sheath 35 sleeves and wraps around the metal hook 36, the fixing screw 34 sequentially penetrates through a through hole in the hook holder 38, a through hole in the plastic sheath 35, and a through hole in the metal hook 36 and is locked with the self-locking nut 37. After the metal hook 36 is wrapped in the plastic sheath 35, the plastic sheath 35 can rotate by 90° to be folded and be parallel to the cushion cloth 3 as shown in FIG. 3*a* from being perpendicular to the cushion cloth 3 of the cushion assembly 2. When the hook assemblies 1 need to be folded, the metal hooks 36 wrapped with the plastic sheaths 35 are rotated to be hidden below the cushion cloth 3 and be parallel to the cushion cloth 3. When the hook assemblies 1 need to be unfolded, the metal hooks 36 wrapped with the plastic sheaths 35 are rotated by 90° to be perpendicular to the cushion cloth 3.

By adoption of the plastic sheaths 35, the abrasion between the metal hooks 36 and a bleacher where the bleacher seat is assembled is reduced. The square tubes and circular tubes in this embodiment can be replaced with tubes of other cross-section shapes.

Figure 4:
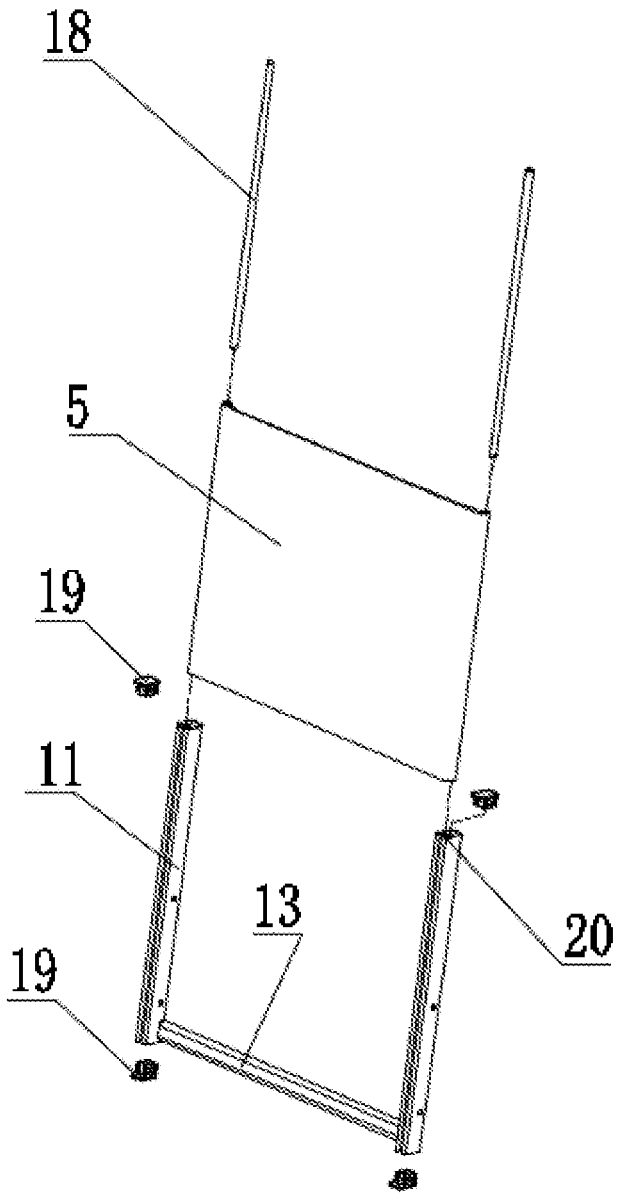
FIG. 4 is a schematic diagram of a backrest assembly of the bleacher seat with slotted pipe sliding armrests.

As shown in FIG. 4, the backrest cloth 5 of the bleacher seat in this embodiment is assembled or disassembled to be cleaned as follows: when the backrest cloth 5 of the bleacher seat is assembled, the backrest weld assembly 11 is fixed, then the cloth embedding strips 18 penetrate through the inner circles of the cylindrical sleeves of the backrest cloth 5 to be combined with the backrest cloth 5 and then stretch into the inner circles of the circular slots 20 in the backrest weld assembly 11 until the large flat surface of the backrest cloth 5 is located between the two vertical backrest rods of the backrest weld assembly 11 and is elastically tensioned slightly, and finally, the slotted tube plugs 19 are assembled. The backrest cloth 5 can be disassembled to be cleaned by performing the operations reversely.

As shown in FIG. 7*a* to FIG. 7*d*, the vertical tubes of the armrest assemblies 4 in this embodiment are unfolded or folded as follows: when the bleacher seat is in the unfolded state, the spring fastener protrusions 12, which are hidden in inner holes of the lower vertical armrest tubes 8 and located in the spring fastener fixing holes 47, of the spring fasteners 42 are exactly clamped in the upper vertical tube holes I 46 of the upper vertical armrest tubes 9, so that the upper vertical armrest tubes 9 are disposed around the lower vertical armrest tubes 8 and are locked and connected to the lower vertical armrest tubes 8 under the effect of the spring fastener protrusions 12 of the spring fasteners 42; and at this moment, the rivets 24 on the slotted armrests 10 are connected to the tail ends of the long slots 40. When the vertical tubes are to be folded, the spring fastener protrusions 12 of the spring fasteners 42 are pressed by hand into inner holes of the upper vertical armrest tubes 9, and then the upper vertical armrest tubes 9 are slid along the outer circles of the lower vertical armrest tubes 8 to be retracted; and when the spring fastener protrusions 12 are exactly clamped in the upper vertical holes II 45, the slotted armrests 10 slide under the restriction of the rivets 24 and the long slots 40 to drive the backrest assembly 6 to be folded and to be locked. When the bleacher seat needs to be unfolded, the spring fastener protrusions 12 are pressed by hand into the inner holes of the upper vertical armrest tubes 9, and the upper vertical armrest tubes 9 are slid along the outer circles of the lower vertical armrest tubes 8; and when the spring fastener protrusions 12 are exactly clamped in the upper vertical tube holes I 46, the bleacher seat is unfolded and locked. To facilitate manual folding and unfolding of the bleacher seat, the spring fastener 42 may be disposed in the vertical armrest tube on one side.

Figure 3B:
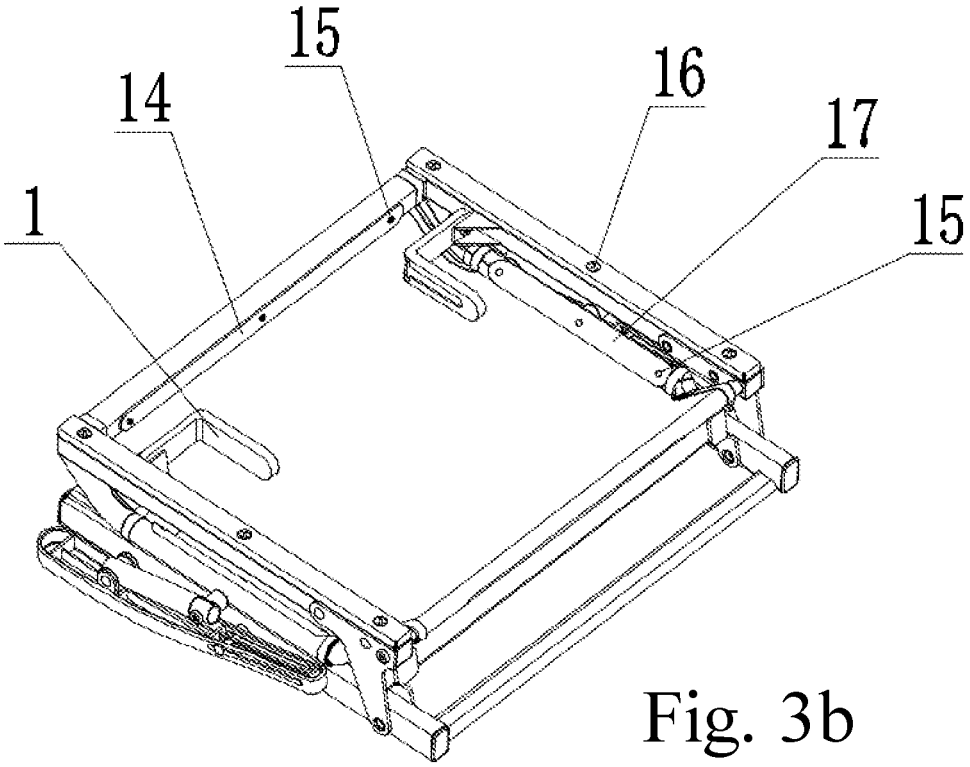
FIG. 3*b* is a schematic diagram of the bleacher seat with slotted pipe sliding armrests in the state where a folded cushion faces upwards.

As shown in FIG. 3*a* and FIG. 3*b*, the bleacher seat in this embodiment is folded as follows: first of all, the metal hooks 36 and plastic sheaths 35 of the hook assemblies 1 are rotated together by 90° to be parallel to the cushion cloth 3 and be located below the cushion cloth 3; and then the spring fastener protrusions 12 are pressed by hand to enable the upper vertical armrest tubes 9 to slide around the lower vertical armrest tubes 8, so that the slotted armrests 10 and the backrest assembly 6 are driven to move around the rotation points of the cushion-backrest connecting assemblies 7 towards the cushion assembly 2. In this way, the hook assemblies 1, the cushion assembly 2, the backrest assembly 6, and the armrest assemblies 4 are folded on one plane layer by layer to facilitate storage and transportation of the bleacher seat.

Figure 2A:
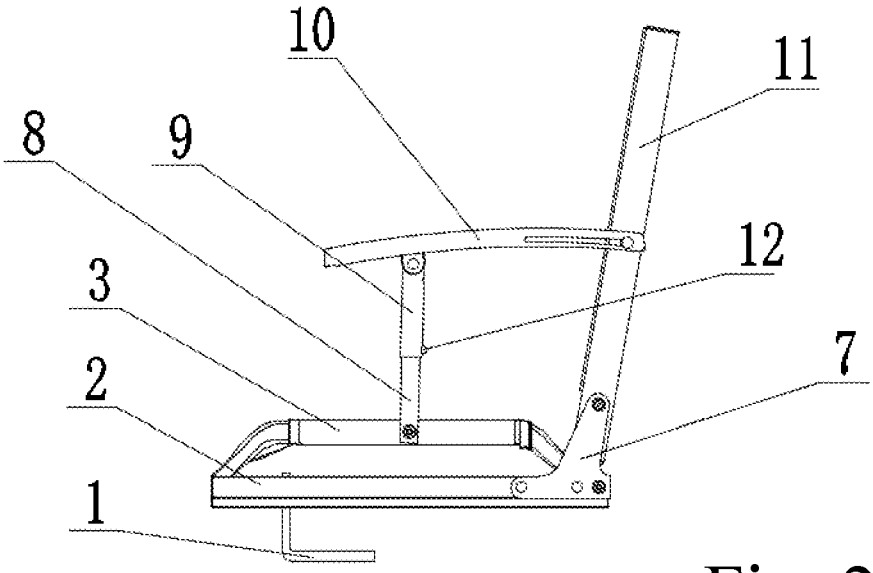
FIG. 2*a* is schematic diagram of the bleacher seat with slotted pipe sliding armrests, in an unfolded state.
Figure 2B:
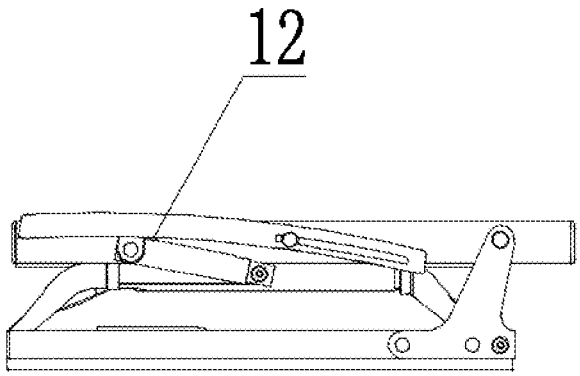
FIG. 2*b* is a schematic diagram of the bleacher seat in a folded and stored state.

As shown in FIG. 1, FIG. 2A, and FIG. 2*b*, the bleacher seat in this embodiment is unfolded as follows: first of all, the spring fastener protrusions 12 are pressed by hand to enable the upper vertical armrest tubes 9 to slide along the outer circles of the lower vertical armrest tubes 8, and at this moment, the slotted armrests 10 and the backrest assembly 6 are driven to rotate away from the cushion assembly 2 around the rotation points of the cushion-backrest connecting assemblies 7. When the spring fastener protrusions 12 are exactly clamped in the upper vertical tube holes I 46, the bleacher seat is unfolded and locked.

Embodiment 2

Figure 8A:
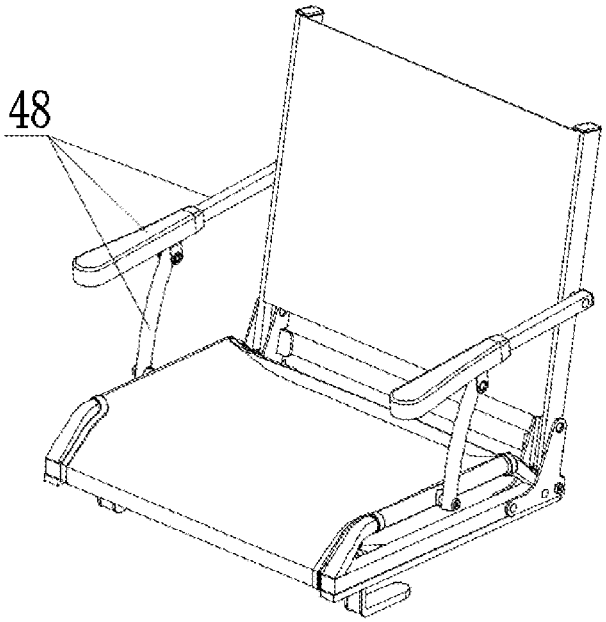
FIG. 8*a* is a perspective view of a bleacher seat with pull-type armrests, in an unfolded state.
Figure 8B:
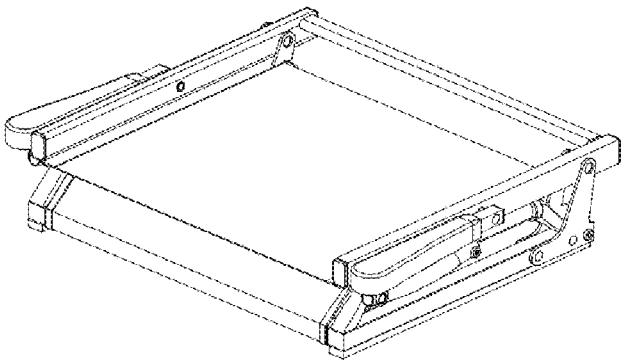
FIG. 8*b* is a perspective view of the bleacher seat with pull-type armrests, in a folded state.
Figure 9:
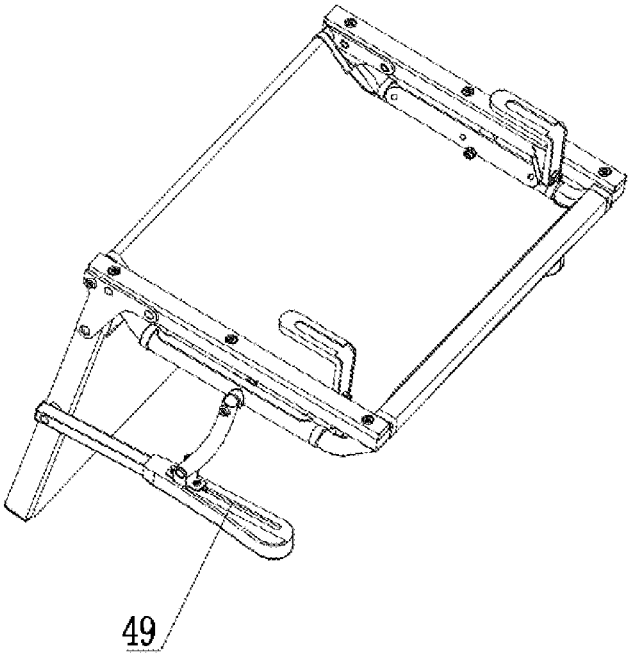
FIG. 9 is a turning perspective view of the bleacher seat with pull-type armrests.
Figure 10:
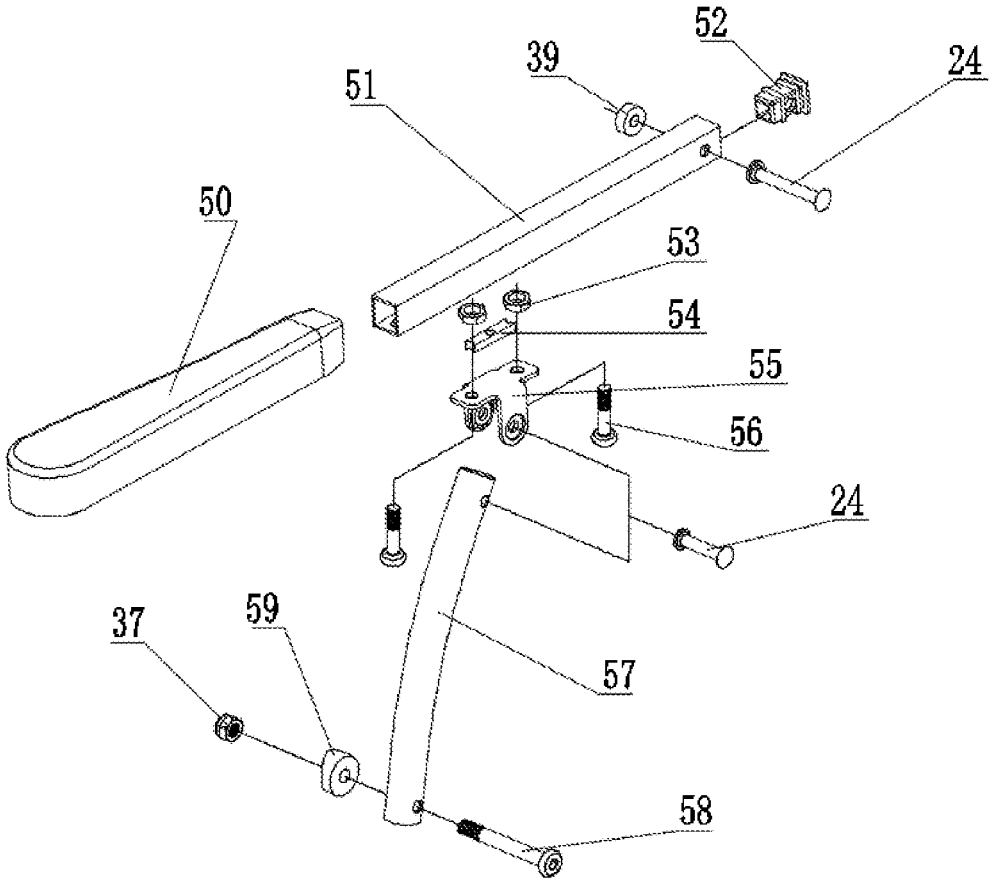
FIG. 10 is an exploded view of a pull-type armrest.

Different from Embodiment 1, this embodiment provides an armrest assembly of another structure, which particularly refers to a pull-type armrest assembly 48 (as shown in FIG. 8*a*, FIG. 8B, and FIG. 9). The pull-type armrest assembly 48 primarily consists of a pull-type armrest 50, a square armrest tube 51, a tube plug 52, two nuts 53, a shim plate 54, a U-shaped armrest piece 55, two screws 56, an upright armrest tube 57, an internal hexagonal screw 58, an upright armrest tube gasket 59, two rivets 24, and a self-locking nut 37, wherein the pull-type armrest 50, the square armrest tube 51, and the upright armrest tube 57 are key components, a long slot 49 is formed in the bottom surface of the pull-type armrest 50, the square armrest tube 51 slides in the long slot 49, the lower surface of the front end of the square armrest tube 51 is rotatably connected to the upper end of the upright armrest tube 57, and the lower end of the upright armrest tube 57 is rotatably connected to the left side or right side of the cushion assembly 2.

Figure 12:
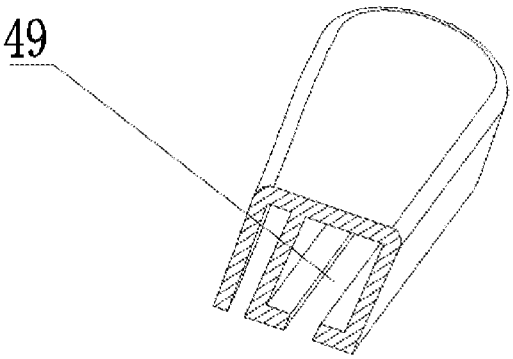
FIG. 12 is a half sectional view of the pull-type armrest.
Figure 13A:
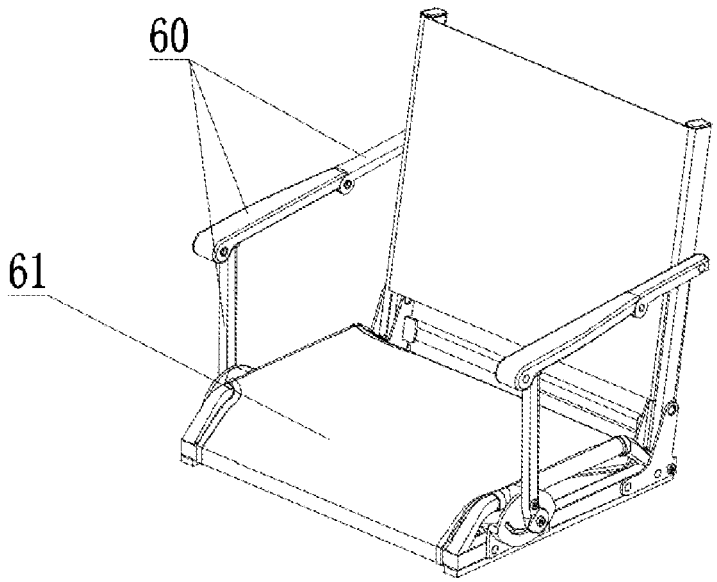
FIG. 13*a* is a perspective view of a bleacher seat with folding armrests, in an unfolded state.
Figure 13B:
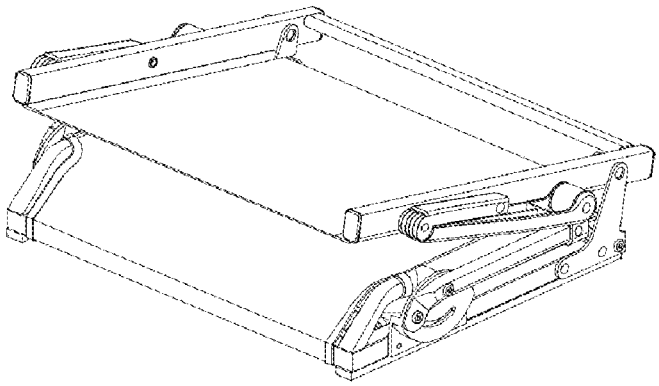
FIG. 13*b* is a perspective view of the bleacher seat with folding armrests, in a folded state.

Particularly, the long slot 49 is formed in the side, towards the ground, of the pull-type armrest 50 (as shown in FIG. 9 and FIG. 12) and has a square inner cavity (as shown in FIG. 12) allowing the outer square surface of the square armrest tube 51 to be inserted therein. The square armrest tube 51 is of a hollow square tube structure and has two through holes close to the lower portion of the pull-type armrest 50, and the distance between the through holes is equal to the distance between two through holes formed in the U-shaped armrest piece 55. The two nuts 53 are arranged in the hollow inner cavity of the square armrest tube 51, the shim plate 54 is located below the two through holes of the square armrest tube 51 and is of a rectangular structure, the width of the shim plate 54 is slightly smaller than that of the long slot 49, the two ends, in the length direction, of the shim plate 54 are in semi-arc shapes, the distance between the two semi-arcs of the shim plate 54 is slightly smaller than the distance between the two through holes in the U-shaped armrest piece 55, and the mounting position of the shim plate 54 in the width direction is limited within the width range of the long slot 49, so that the shim plate 49 is able to move in the length direction of the long slot 49. The U-shaped armrest piece 55 is located below the shim plate 54 and has an opening facing downwards and a flat bottom formed with the two through holes. The screws 56 penetrate through the through holes in the U-shaped armrest piece 55, then penetrate through the long slot 49 of the pull-type armrest 50 to lean against the semi-arcs of the shim plate 54, and finally stretch out of the through holes in the square armrest tube 51 to be assembled and combined with the nuts 53. The opening of the U-shaped armrest piece 55 is connected to one end of the upright armrest tube 57 through one rivet 24, and the other end of the upright armrest tube 57 is rotatably connected to the corresponding side cloth-pulling tube 31 through the internal hexagonal screw 58, the upright armrest tube gasket 59 and the self-locking nut 37. The end, away from the pull-type armrest 50, of the square armrest tube 51 is rotatably connected to the backrest weld assembly 11 through the other rivet 24 and the gasket 39. The tube plug 52 is mounted at an opening of the end, connected to the backrest weld assembly 11, of the square armrest tube 51.

Figure 11A:
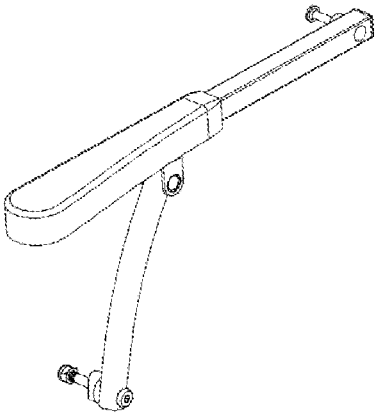
FIG. 11*a* is a schematic diagram of a pull-type armrest assembly in an unfolded state.
Figure 11B:
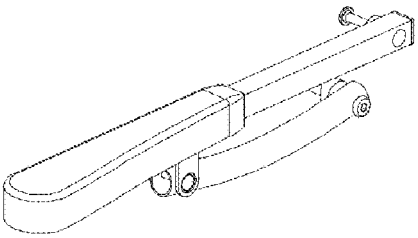
FIG. 11*b* is a schematic diagram of the pull-type armrest in a retracted and folded state.
Figure 11C:
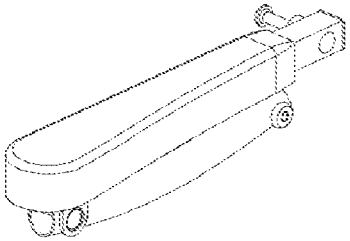
FIG. 11*c* is another schematic diagram of the pull-type armrest in the retracted and folded state.

As shown in FIG. 11*a* to FIG. 11*c*, the pull-type armrest assembly 48 is unfolded or folded as follows: when the bleacher seat is in the folded state, the upright armrest tube 57 rotates around the corresponding rivet 24 to be approximately parallel to the side cloth-pulling tube 31, and the square armrest tube 51 connected to the upright armrest tube 57 through the U-shaped armrest piece 55, and the pull-type armrest that can be pulled to move are also approximately in parallel; at this moment, the pull-type armrest 50 can move in the length direction of the square armrest tube 51; and generally, in the folded state, the length is minimized after the square armrest tube 51 is inserted into the pull-type armrest 50 (as shown in FIG. 11*b* and FIG. 11*c*). When the bleacher seat needs to be unfolded, the pull-type armrest 50 is pulled to move outwards along the square armrest tube 51 and is then lifted, and at this moment, the square armrest tube 51 and the upright armrest tube 57 are mechanically driven to move accordingly; and when the backrest assembly 6 is completely unfolded, an angle (allowing users to sit on the bleacher seat comfortably) is formed between the upright armrest tube 57 and the square armrest tube 51 (as shown in FIG. 11*a*). In this way, the pull-type armrest assembly and the bleacher seat are completely unfolded. The bleacher seat can be unfolded by performing the operations reversely.

Embodiment 3

Figure 15A:
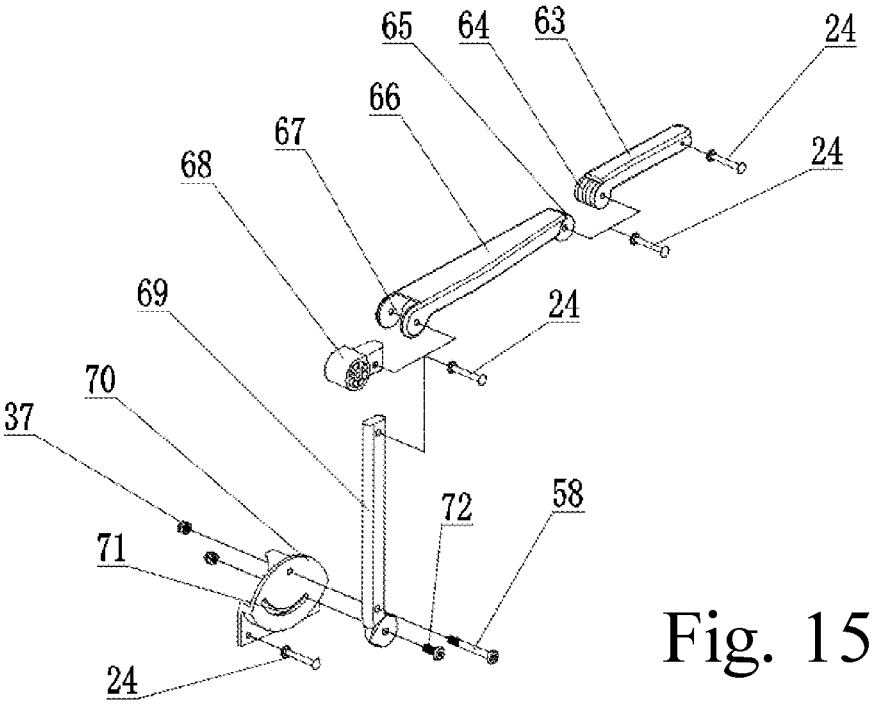
FIG. 15*a* is an exploded view of a folding armrest.
Figure 15B:
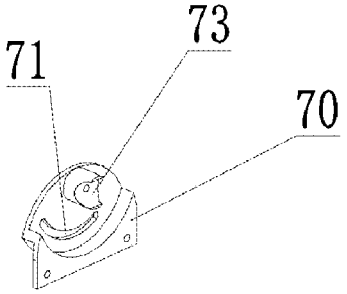
FIG. 15*b* is a structural diagram of a support tube fixing piece.

Different from Embodiment 1 or 2, this embodiment provides an armrest assembly of another structure, which particularly refers to a folding armrest assembly 60. The folding armrest assembly 60 primarily consists of a rear folding armrest piece 63, a front folding armrest piece 66, a circular armrest connecting head 68, an armrest support tube 69, a support tube fixing piece 70, a short bolt 72, and five rivets 24 (as shown in FIG. 15*a* and FIG. 15*b*).

The rear folding armrest piece 63, the front folding armrest piece 66, the armrest support tube 69, and the support tube fixing piece 70 are key components; a through hole is formed in the rear end of the rear folding armrest piece 63, and one rivet 24 penetrates through the through hole to rotatably connect the rear end of the rear folding armrest piece 63 to the backrest weld assembly 11. The front end of the rear folding armrest piece 63 is formed with a biconcave notch 64, which allows a biconvex protrusion 65 at the rear end of the front folding armrest piece 66 to be assembled therein to rotatably connect the front end of the rear folding armrest piece 63 to the rear end of the front folding armrest piece 66. The front end of the front folding armrest piece 66 is rotatably connected to the upper end of the armrest support tube 69, two through holes are formed in the lower end of the armrest support tube 69 and are located at different heights, the internal hexagonal screw 58 penetrates through one through hole to be fixed to the support tube fixing piece 70, and the armrest support tube 69 is able to rotate with respect to the internal hexagonal screw 58; an arc groove 71 is formed in the support tube fixing piece 70, and the short bolt 72 penetrates through the other through hole and the arc groove 71 to be fixed and is able to slide along the arc groove 71 to rotatably connect the lower end of the armrest support tube 60 to the left side or right side of the cushion assembly 2; and the support tube fixing piece 70 is fixed to the left side or right side of the cushion assembly 2 through one rivet 24. Particularly, one end of the rear folding armrest piece 63 is formed with one through hole and is rotatably connected to the backrest weld assembly 11 through one rivet 24, the other end of the rear folding armrest piece 63 is formed with the biconcave notch 64 and is rotatably connected to the front folding armrest piece 66 after the biconvex protrusion 65 on the front folding armrest piece 66 is assembled in the biconcave notch 64 through one rivet 24, a big notch 67 is formed in the end, away from the biconvex protrusion 65, of the front folding armrest piece 66, the whole circular armrest connecting head 68 is of a flat tube structure, the lower end of the circular armrest connecting head 68 is of an oblate structure, the end of the flat tube structure of the circular armrest connecting head 68 is located in a concave part of the big notch 67, and the armrest support tube 69 has an end inserted into an inner cavity of the circular armrest connecting head 68 and is rotatably connected to the circular armrest connecting head 68 and the big notch 67 of the front folding armrest piece 66 through one rivet 24. Two through holes are formed in the other end of the armrest support tube 69, wherein one through hole is located on the flat tube of the armrest support tube 69, is fixed to the support tube fixing piece 70 through the internal hexagonal screw 58, and is locked with the self-locking nut 37, and the armrest support tube 69 is able to rotate with respect to the internal hexagonal screw 58; and the other through hole is located at the center of the oblate structure of the circular armrest connecting head 68, and the short bolt 72 penetrates through the through hole to be located in the arc groove 71 of the support tube fixing piece 70 and is able to slide along the arc groove 71 through the self-locking nut 37 to fulfill fastening and connection. The support tube fixing piece 70 is a special-shaped disk part, a semicircular matching base 73 matched with the outer surface of the side cloth-pulling tube is arranged on the side, connected to the side cloth-pulling tube 31, of the support tube fixing piece 70, and the support tube fixing piece 70 is fixedly mounted on the outer sides of the left and right side square tubes of the cushion tube weld assembly through rivets 24 (as shown in FIG. 14).

Figure 14:
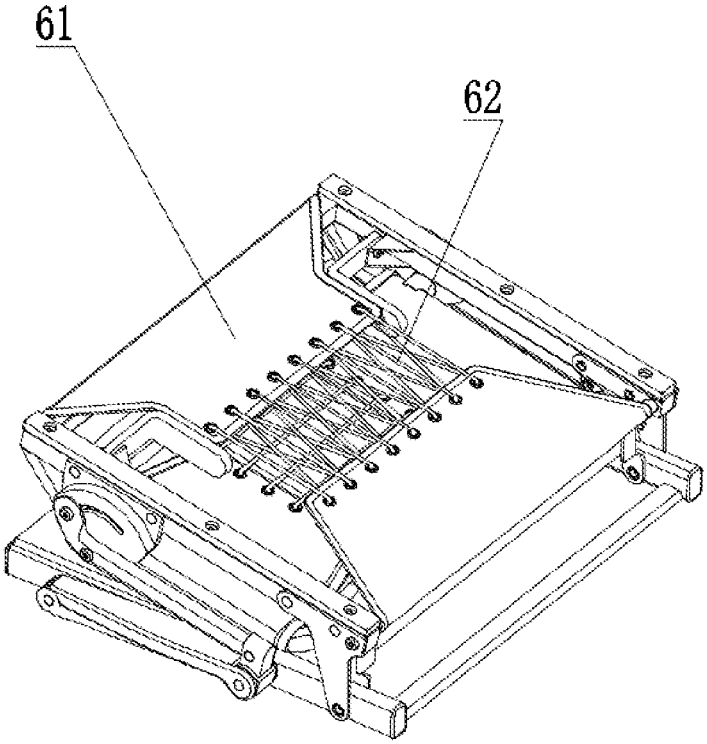
FIG. 14 is a turning perspective view of the bleacher seat with folding armrests.
Figure 16A:
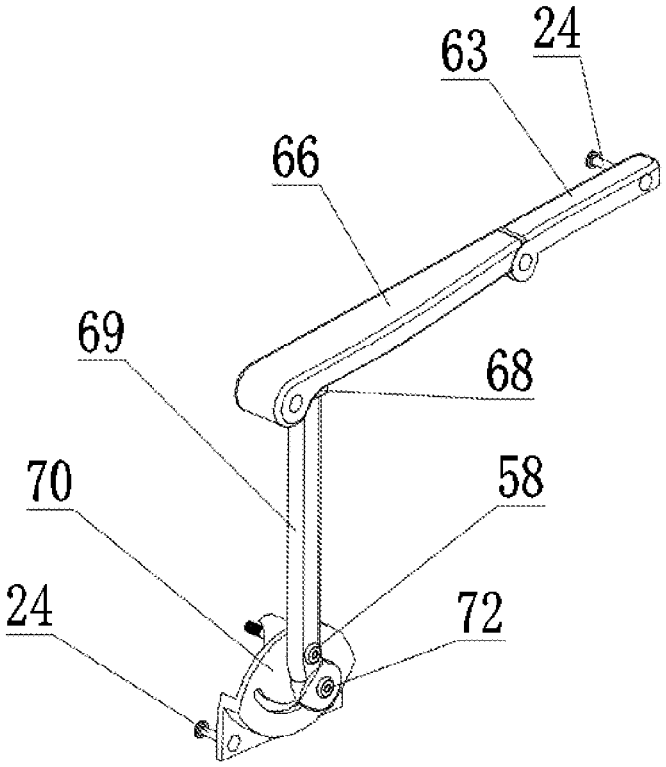
FIG. 16*a* is a schematic diagram of a folding armrest assembly in an unfolded state.
Figure 16B:
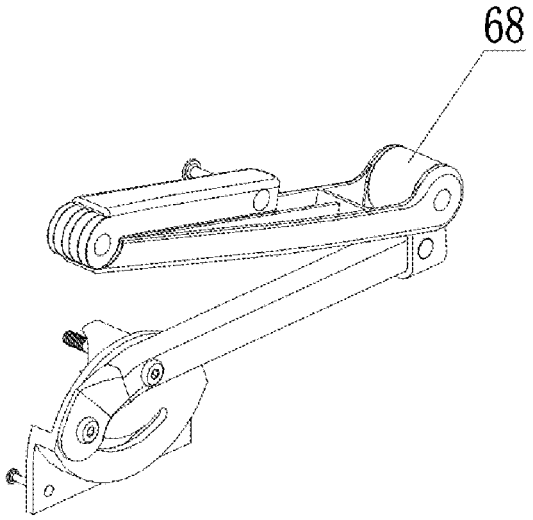
FIG. 16*b* is a schematic diagram of the folding armrest in a retracted and folded state.

As shown in FIG. 16, the folding armrest assembly 60 is unfolded or folded as follows: when the bleacher seat is in the folded state (as shown in FIG. 14), the rear folding armrest piece 63 is rotated and folded around the biconcave notch 64 connected to the biconvex protrusion through the rivet 24 until the angle between the rear folding armrest piece 63 and the front folding armrest piece 66 is minimized and the rear folding armrest piece 63 and the front folding armrest piece 66 form a whole, then the front folding armrest piece 66 is rotated around the circular armrest connecting head 68 until the angle between the front folding armrest piece 66 and the armrest support tube 69 is minimized and the front folding armrest piece 66 and the armrest support tube 69 form a whole, then the armrest support tube 69 is rotated to enable the short bolt 72 thereof to slide along the arc groove 71 of the support tube fixing piece 70 to reach the notch in the farthest end, and at this moment, the armrest support tube 69 is approximately located at the same horizontal position as the left and right side square tubes of the cushion tube weld assembly. Meanwhile, the backrest assembly 6 is driven to move towards the cushion assembly 2 until the angle between the backrest assembly 6 and the cushion assembly 2 is minimized. The bleacher seat can be unfolded by performing the operations reversely.

Embodiment 4

Figure 17A:
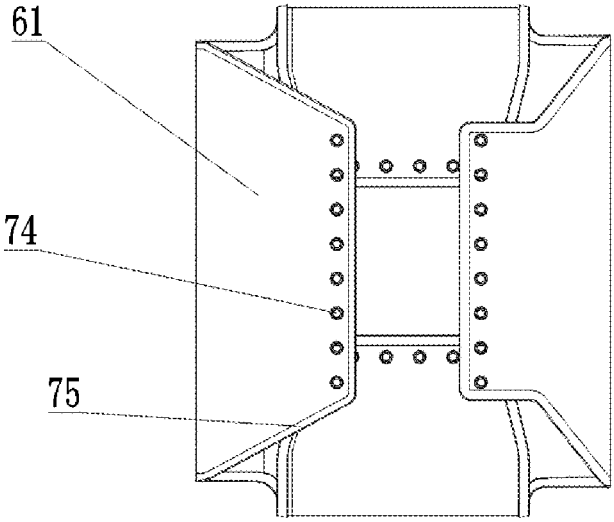
FIG. 17*a* is a vertical view of a square tube-rope cushion cloth in a collapsed state.
Figure 17B:
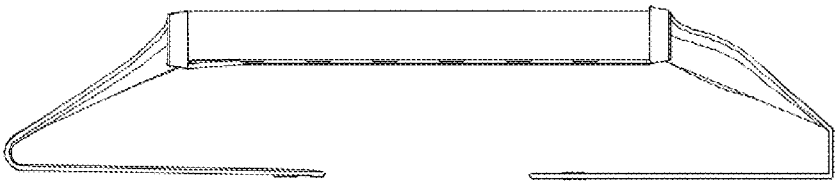
FIG. 17*b* is a side view of the square tube-rope cushion cloth in the collapsed state.

Different from the above embodiments, this embodiment provides a cushion cloth of another structure, which particularly refers to a square tube-rope cushion cloth 61 (as shown in FIG. 14, FIG. 17*a* and FIG. 17*b*). The square tube-rope cushion cloth 61 is mounted on the cushion tube weld assembly of the cushion assembly 2 and wraps around the cushion tube weld assembly, wherein the left and right sides of the square tube-rope cushion cloth 61 wrap the side cloth-pulling tubes 31, the front and back sides of the square tube-rope cushion cloth 61 wrap the horizontal square tube 33 and the rear tube 30 of the cushion tube weld assembly, and thickened rims 75 are arranged on the four sides of the square tube-rope cushion cloth 61, different numbers of metal ring through holes 74 are formed in the edges of the front and back rims 75 and in the edges of the left and right rims 75, and a rope 62 penetrates through the metal ring through holes 75 and is tied in a way similar to shoelaces to fulfill fixation and connection.

The aforementioned embodiments are only preferred ones of this utility model, and are not intended to limit the protection scope of this utility mode, and all transformations and improvements made by those skilled in the art according to the design concept of this utility model should also fall within the protection scope of this utility model. More particularly, various transformations and improvements can be made to the constituent parts and/or the layout of the subject matter within the scope of the drawings and claims of this application

What is claimed is:

1. A bleacher seat with retractable and foldable armrests, comprising two hook assemblies (1), a cushion assembly (2), a backrest assembly (6), two cushion-backrest connecting assemblies (7), and two armrest assemblies (4), wherein the two hook assemblies (1) are symmetrically arranged at a front end of a bottom surface of the cushion assembly (2), lower ends of the two symmetrical cushion-backrest connecting assemblies (7) are fixedly mounted at rear ends of the left and right sides of the cushion assembly (2) respectively, and upper ends of the two cushion-backrest connecting assemblies (7) are symmetrically arranged at and rotatably connected to lower ends of two sides of the backrest assembly (6); the two armrest assemblies (4) are arranged symmetrically, a lower end and an upper end of each said armrest assembly (4) are rotatably connected to a corresponding side of the cushion assembly (2) and a corresponding side of the backrest assembly (6) respectively, and the armrest assemblies (4) are retractable; and a detachable cushion cloth (3) is arranged on the cushion assembly (2), and a detachable backrest cloth (5) is arranged on the backrest assembly (6); and wherein each said armrest assembly (4) comprises a slotted armrest (10) and a telescopic tube, wherein a slot (40) is formed in a joint of the slotted armrest (10) and a left side or right side of the backrest assembly (6), a rivet (24) sequentially penetrates through the slot (40), a gasket (39) and a side face of a backrest weld assembly (11); and a front end of a lower surface of the slotted armrest (10) is rotatably connected to an upper end of the telescopic tube, and a lower end of the telescopic tube is rotatably connected to the left side or right side of the cushion assembly (2).

2. The bleacher seat with retractable and foldable armrests according to claim 1, wherein the telescopic tube comprises a lower vertical armrest tube (8), an upper vertical armrest tube (9), and a spring fastener (42), wherein the lower vertical armrest tube (8) and the upper vertical armrest tube (9) are hollow tubes, and the upper vertical armrest tube (9) is disposed around an upper end of the lower vertical armrest tube (8);

a spring fastener fixing hole (47) is formed in the upper end of the lower vertical armrest tube (8), the spring fastener (42) is mounted inside the lower vertical armrest tube (8), and a spring fastener protrusion (12) is arranged on any side of an upper end of the spring fastener (42) and stretches out of the spring fastener fixing hole (47); wherein the upper vertical armrest tube (9) has an upper vertical tube hole I (46) and an upper vertical tube hole II (45) which are formed along a same straight line in a length direction and are located at different heights, and is able to slide upwards and downwards; and the spring fastener fixing hole (47) penetrates through the upper vertical tube hole I (46) or the upper vertical tube hole II (45); and a lower end of the lower vertical armrest tube (8) is rotatably connected to the left side or right side of the cushion assembly (3).

3. The bleacher seat with retractable and foldable armrests according to claim 2, wherein the cushion assembly (2) comprises the cushion tube weld assembly the cushion cloth (3), two square tube sleeves (27), and a rear tube (30), wherein a rear end of the cushion cloth (3) is wound around an outer circle of the rear tube (30) through a rear cushion cloth tube sleeve (23);

front ends of the square tube sleeves (27) are mounted at rear ends of left and right sides of the cushion tube weld assembly; mounting holes for mounting the rear tube (30) are formed in sides, facing each other, of the two square tube sleeves (27), and the two square tube sleeves (27) are respectively mounted at two ends of the rear tube (30) via the mounting holes; and through holes are formed in the square tube sleeves (27), and self-tapping screws (25) sequentially penetrate through the through holes of the square tube sleeves (27) and an end face of the rear tube (30) to be fixed; and the two hook assemblies (1) are respectively mounted on inner surfaces of front portions of the left and right sides of the cushion tube weld assembly.

4. The bleacher seat with retractable and foldable armrests according to claim 3, wherein the cushion assembly (2) further comprises a front cushion cloth pressing piece (14) and two side cushion cloth pressing pieces (17); wherein the cushion tube weld assembly comprises a horizontal square tube (33), two side square tubes, two hook holders (38), and two side cloth pulling tubes (31); wherein the two side square tubes are symmetrically welded to two ends of the horizontal square tube (33) to form an n shape, and the two arched side cloth-pulling tubes (31) are respectively welded to upper ends of the two side square tubes; and the two hook holders (38) are respectively welded to the sides, close to the horizontal square tube (33), of the two side square tubes, and the hook assemblies (1) are mounted on the hook holders (38); and side cushion cloth rims (21) on the left and right sides of the cushion cloth (3) are wound around the two side cloth-pulling tubes (31), are pressed against the side cloth-pulling tubes (31) by means of the side cushion cloth pressing pieces (17), and are fixed with pressing piece screws (15); and a front cushion cloth rim (22) on a front side of the cushion cloth (3) is wound around the horizontal square tube (33), is pressed against the horizontal square tube (33) by means of the front cushion cloth pressing piece (14), and is fixed with a pressing piece screw (15).

5. The bleacher seat with retractable and foldable armrests according to claim 1, wherein the cushion assembly (2) comprises a cushion tube weld assembly the cushion cloth (3), two square tube sleeves (27), and a rear tube (30), wherein a rear end of the cushion cloth (3) is wound around an outer circle of the rear tube (30) through a rear cushion cloth tube sleeve (23);

front ends of the square tube sleeves (27) are mounted at rear ends of left and right sides of the cushion tube weld assembly; mounting holes for mounting the rear tube (30) are formed in sides, facing each other, of the two square tube sleeves (27), and the two square tube sleeves (27) are respectively mounted at two ends of the rear tube (30) via the mounting holes; and through holes are formed in the square tube sleeves (27), and self-tapping screws (25) sequentially penetrate through the through holes of the square tube sleeves (27) and an end face of the rear tube (30) to be fixed; and the two hook assemblies (1) are respectively mounted on inner surfaces of front portions of the left and right sides of the cushion tube weld assembly.

6. The bleacher seat with retractable and foldable armrests according to claim 5, wherein the cushion assembly (2) further comprises a front cushion cloth pressing piece (14) and two side cushion cloth pressing pieces (17); wherein the cushion tube weld assembly comprises a horizontal square tube (33), two side square tubes, two hook holders (38), and two side cloth pulling tubes (31); wherein the two side square tubes are symmetrically welded to two ends of the horizontal square tube (33) and the two arched side cloth-pulling tubes (31) are respectively welded to upper ends of the two side square tubes; and the two hook holders (38) are respectively welded to the sides, close to the horizontal square tube (33), of the two side square tubes, and the hook assemblies (1) are mounted on the hook holders (38); and side cushion cloth rims (21) on the left and right sides of the cushion cloth (3) are wound around the two side cloth-pulling tubes (31), are pressed against the side cloth-pulling tubes (31) by means of the side cushion cloth pressing pieces (17), and are fixed with pressing piece screws (15); and a front cushion cloth rim (22) on a front side of the cushion cloth (3) is wound around the horizontal square tube (33), is pressed against the horizontal square tube (33) by means of the front cushion cloth pressing piece (14), and is fixed with a pressing piece screw (15).

7. A bleacher seat with retractable and foldable armrests, comprising two hook assemblies (1), a cushion assembly (2), a backrest assembly (6), two cushion-backrest connecting assemblies (7), and two armrest assemblies (4), wherein the two hook assemblies (1) are symmetrically arranged at a front end of a bottom surface of the cushion assembly (2), lower ends of the two symmetrical cushion-backrest connecting assemblies (7) are fixedly mounted at rear ends of the left and right sides of the cushion assembly (2) respectively, and upper ends of the two cushion-backrest connecting assemblies (7) are symmetrically arranged at and rotatably connected to lower ends of two sides of the backrest assembly (6); the two armrest assemblies (4) are arranged symmetrically, a lower end and an upper end of each said armrest assembly (4) are rotatably connected to a corresponding side of the cushion assembly (2) and a corresponding side of the backrest assembly (6) respectively, and the armrest assemblies (4) are retractable; and a detachable cushion cloth (3) is arranged on the cushion assembly (2), and a detachable backrest cloth (5) is arranged on the backrest assembly (6); wherein each said armrest assembly comprises a pull-type armrest (50), a square armrest tube (51), and an upright armrest tube (57), wherein a slot (49) is formed in a bottom surface of the pull-type armrest (50), the square armrest tube (51) slides in the slot (49), a lower surface of a front end of the square armrest tube (51) is rotatably connected to an upper end of the upright armrest tube (57), a rear end of the square armrest tube (51) is rotatably connected to a left side or right side of the backrest assembly (6); and a lower end of the upright armrest tube (57) is rotatably connected to the left side or right side of the cushion assembly (2).

8. The bleacher seat with retractable and foldable armrests according to claim 7, wherein the cushion assembly (2) comprises the cushion tube weld assembly the cushion cloth (3), two square tube sleeves (27), and a rear tube (30), wherein a rear end of the cushion cloth (3) is wound around an outer circle of the rear tube (30) through a rear cushion cloth tube sleeve (23);

front ends of the square tube sleeves (27) are mounted at rear ends of left and right sides of the cushion tube weld assembly; mounting holes for mounting the rear tube (30) are formed in sides, facing each other, of the two square tube sleeves (27), and the two square tube sleeves (27) are respectively mounted at two ends of the rear tube (30) via the mounting holes; and through holes are formed in the square tube sleeves (27), and self-tapping screws (25) sequentially penetrate through the through holes of the square tube sleeves (27) and an end face of the rear tube (30) to be fixed; and the two hook assemblies (1) are respectively mounted on inner surfaces of front portions of the left and right sides of the cushion tube weld assembly.

9. The bleacher seat with retractable and foldable armrests according to claim 8, wherein the cushion assembly (2) further comprises a front cushion cloth pressing piece (14) and two side cushion cloth pressing pieces (17); wherein the cushion tube weld assembly comprises a horizontal square tube (33), two side square tubes, two hook holders (38), and two side cloth pulling tubes (31); wherein the two side square tubes are symmetrically welded to two ends of the horizontal square tube (33) and the two arched side cloth-pulling tubes (31) are respectively welded to upper ends of the two side square tubes; and the two hook holders (38) are respectively welded to the sides, close to the horizontal square tube (33), of the two side square tubes, and the hook assemblies (1) are mounted on the hook holders (38); and side cushion cloth rims (21) on the left and right sides of the cushion cloth (3) are wound around the two side cloth-pulling tubes (31), are pressed against the side cloth-pulling tubes (31) by means of the side cushion cloth pressing pieces (17), and are fixed with pressing piece screws (15); and a front cushion cloth rim (22) on a front side of the cushion cloth (3) is wound around the horizontal square tube (33), is pressed against the horizontal square tube (33) by means of the front cushion cloth pressing piece (14), and is fixed with a pressing piece screw (15).

10. A bleacher seat with retractable and foldable armrests, comprising two hook assemblies (1), a cushion assembly (2), a backrest assembly (6), two cushion-backrest connecting assemblies (7), and two armrest assemblies (4), wherein the two hook assemblies (1) are symmetrically arranged at a front end of a bottom surface of the cushion assembly (2), lower ends of the two symmetrical cushion-backrest connecting assemblies (7) are fixedly mounted at rear ends of the left and right sides of the cushion assembly (2) respectively, and upper ends of the two cushion-backrest connecting assemblies (7) are symmetrically arranged at and rotatably connected to lower ends of two sides of the backrest assembly (6); the two armrest assemblies (4) are arranged symmetrically, a lower end and an upper end of each said armrest assembly (4) are rotatably connected to a corresponding side of the cushion assembly (2) and a corresponding side of the backrest assembly (6) respectively, and the armrest assemblies (4) are retractable; and a detachable cushion cloth (3) is arranged on the cushion assembly (2), and a detachable backrest cloth (5) is arranged on the backrest assembly (6); wherein each said armrest assembly comprises a rear folding armrest piece (63), a front folding armrest piece (66), an armrest support tube (69) and a support tube fixing piece (70), wherein a through hole is formed in a rear end of the rear folding armrest piece (63), and a rivet (24) penetrates through the through hole to rotatably connect the rear end of the rear folding armrest piece (63) to a left side or right side of the backrest assembly (6); and a biconcave notch (64) is formed in a front end of the rear folding armrest assembly (63) and allows a biconvex protrusion (65) at a rear end of the front folding armrest piece (66) to be assembled therein through a rivet (24) to rotatably connect the front end of the rear folding armrest assembly (63) to the rear end of the front folding armrest piece (66);

a front end of the front folding armrest piece (66) is rotatably connected to an upper end of the armrest support tube (69), two through holes are formed in a lower end of the armrest support tube (69) and are located at different heights, an internal hexagonal screw (58) penetrates through one said through hole to be fixed to the support tube fixing piece (70), and the armrest support tube (69) is able to rotate around the screw (58); and an arc groove (71) is formed in the support tube fixing piece (70), and a short bolt (72) penetrates through the other through hole and the arc groove (71) to be fixed and is able to slide along the arc groove (71) to rotatably connect the lower end of the armrest support tube (69) to the left side or right side of the cushion assembly (2); and the support tube fixing piece (70) is fixed to the left side or right side of the cushion assembly (2) through a rivet (24).

11. The bleacher seat with retractable and foldable armrests according to claim 10, wherein the cushion assembly (2) comprises the cushion tube weld assembly the cushion cloth (3), two square tube sleeves (27), and a rear tube (30), wherein a rear end of the cushion cloth (3) is wound around an outer circle of the rear tube (30) through a rear cushion cloth tube sleeve (23);

front ends of the square tube sleeves (27) are mounted at rear ends of left and right sides of the cushion tube weld assembly; mounting holes for mounting the rear tube (30) are formed in sides, facing each other, of the two square tube sleeves (27), and the two square tube sleeves (27) are respectively mounted at two ends of the rear tube (30) via the mounting holes; and through holes are formed in the square tube sleeves (27), and self-tapping screws (25) sequentially penetrate through the through holes of the square tube sleeves (27) and an end face of the rear tube (30) to be fixed; and the two hook assemblies (1) are respectively mounted on inner surfaces of front portions of the left and right sides of the cushion tube weld assembly.

12. The bleacher seat with retractable and foldable armrests according to claim 11, wherein the cushion assembly (2) further comprises a front cushion cloth pressing piece (14) and two side cushion cloth pressing pieces (17); wherein the cushion tube weld assembly comprises a horizontal square tube (33), two side square tubes, two hook holders (38), and two side cloth pulling tubes (31); wherein the two side square tubes are symmetrically welded to two ends of the horizontal square tube (33) and the two arched side cloth-pulling tubes (31) are respectively welded to upper ends of the two side square tubes; and the two hook holders (38) are respectively welded to the sides, close to the horizontal square tube (33), of the two side square tubes, and the hook assemblies (1) are mounted on the hook holders (38); and side cushion cloth rims (21) on the left and right sides of the cushion cloth (3) are wound around the two side cloth-pulling tubes (31), are pressed against the side cloth-pulling tubes (31) by means of the side cushion cloth pressing pieces (17), and are fixed with pressing piece screws (15); and a front cushion cloth rim (22) on a front side of the cushion cloth (3) is wound around the horizontal square tube (33), is pressed against the horizontal square tube (33) by means of the front cushion cloth pressing piece (14), and is fixed with a pressing piece screw (15).

13. A bleacher seat with retractable and foldable armrests, comprising two hook assemblies (1), a cushion assembly (2), a backrest assembly (6), two cushion-backrest connecting assemblies (7), and two armrest assemblies (4), wherein the two hook assemblies (1) are symmetrically arranged at a front end of a bottom surface of the cushion assembly (2), lower ends of the two symmetrical cushion-backrest connecting assemblies (7) are fixedly mounted at rear ends of the left and right sides of the cushion assembly (2) respectively, and upper ends of the two cushion-backrest connecting assemblies (7) are symmetrically arranged at and rotatably connected to lower ends of two sides of the backrest assembly (6); the two armrest assemblies (4) are arranged symmetrically, a lower end and an upper end of each said armrest assembly (4) are rotatably connected to a corresponding side of the cushion assembly (2) and a corresponding side of the backrest assembly (6) respectively, and the armrest assemblies (4) are retractable; and a detachable cushion cloth (3) is arranged on the cushion assembly (2), and a detachable backrest cloth (5) is arranged on the backrest assembly (6); wherein the cushion assembly (2) comprises a cushion tube weld assembly the cushion cloth (3), two square tube sleeves (27), and a rear tube (30), wherein a rear end of the cushion cloth (3) is wound around an outer circle of the rear tube (30) through a rear cushion cloth tube sleeve (23);

front ends of the square tube sleeves (27) are mounted at rear ends of left and right sides of the cushion tube weld assembly; mounting holes for mounting the rear tube (30) are formed in sides, facing each other, of the two square tube sleeves (27), and the two square tube sleeves (27) are respectively mounted at two ends of the rear tube (30) via the mounting holes; and through holes are formed in the square tube sleeves (27), and self-tapping screws (25) sequentially penetrate through the through holes of the square tube sleeves (27) and an end face of the rear tube (30) to be fixed; and the two hook assemblies (1) are respectively mounted on inner surfaces of front portions of the left and right sides of the cushion tube weld assembly.

14. The bleacher seat with retractable and foldable armrests according to claim 13, wherein the cushion assembly (2) further comprises a front cushion cloth pressing piece (14) and two side cushion cloth pressing pieces (17); wherein the cushion tube weld assembly comprises a horizontal square tube (33), two side square tubes, two hook holders (38), and two side cloth pulling tubes (31); wherein the two side square tubes are symmetrically welded to two ends of the horizontal square tube (33) and the two arched side cloth-pulling tubes (31) are respectively welded to upper ends of the two side square tubes; and the two hook holders (38) are respectively welded to the sides, close to the horizontal square tube (33), of the two side square tubes, and the hook assemblies (1) are mounted on the hook holders (38); and side cushion cloth rims (21) on the left and right sides of the cushion cloth (3) are wound around the two side cloth-pulling tubes (31), are pressed against the side cloth-pulling tubes (31) by means of the side cushion cloth pressing pieces (17), and are fixed with pressing piece screws (15); and a front cushion cloth rim (22) on a front side of the cushion cloth (3) is wound around the horizontal square tube (33), is pressed against the horizontal square tube (33) by means of the front cushion cloth pressing piece (14), and is fixed with a pressing piece screw (15).

15. The bleacher seat with retractable and foldable armrests according to claim 14, wherein the backrest assembly (6) comprises two cloth embedding strips (18), the backrest cloth (5), the backrest weld assembly (11), and four slotted tube plugs (19), wherein the backrest weld assembly (11) is structure formed by welding two vertical backrest rods and a horizontal backrest tube (13), circular slots (20) are formed in the sides of the two vertical backrest rods, cylindrical sleeves allowing the cloth embedding strips (18) to be inserted therein are arranged on the left and right sides of the backrest cloth (5), and the cylindrical sleeves having the cloth embedding strips (18) inserted therein are embedded in the circular slots (20); and the four slotted tube plugs (19) seal open ends of the two vertical backrest rods.

16. The bleacher seat with retractable and foldable armrests according to claim 15, wherein each said cushion-backrest connecting assembly (7) comprises an outer cushion-backrest connecting piece (26) and a cushion-backrest hole connecting piece (28), wherein the outer cushion-backrest connecting piece (26) is riveted to outer sides of rear ends of the side square tubes of the cushion tube weld assembly, and lower ends of the vertical backrest rods of the cushion-backrest weld assembly (11) are rotatably connected to the outer cushion-backrest connecting piece (26) and the cushion-backrest hole connecting piece (28).

17. The bleacher seat with retractable and foldable armrests according to claim 16, wherein each said hook assembly (1) comprises a screw (34), a plastic sheath (35), a metal hook (36), and a self-locking nut (37), wherein the plastic sheath (35) wraps around the metal hook (36), and the fixing screw (34) sequentially penetrates through a through hole in the corresponding hook holder (38) of the cushion assembly (2), a through hole in the plastic sheath (35) and a through hole in the metal hook (36) to be locked with the self-locking nut (37).

18. The bleacher seat with retractable and foldable armrests according to claim 14, wherein each said hook assembly (1) comprises a screw (34), a plastic sheath (35), a metal hook (36), and a self-locking nut (37), wherein the plastic sheath (35) wraps around the metal hook (36), and the fixing screw (34) sequentially penetrates through a through hole in the corresponding hook holder (38) of the cushion assembly (2), a through hole in the plastic sheath (35) and a through hole in the metal hook (36) to be locked with the self-locking nut (37).

19. The bleacher seat with retractable and foldable armrests according to claim 15, wherein each said hook assembly (1) comprises a screw (34), a plastic sheath (35), a metal hook (36), and a self-locking nut (37), wherein the plastic sheath (35) wraps around the metal hook (36), and the fixing screw (34) sequentially penetrates through a through hole in the corresponding hook holder (38) of the cushion assembly (2), a through hole in the plastic sheath (35) and a through hole in the metal hook (36) to be locked with the self-locking nut (37).

* * * * *